US006679168B1

(12) United States Patent
Shih

(10) Patent No.: US 6,679,168 B1
(45) Date of Patent: Jan. 20, 2004

(54) PORTABLE STAMP

(76) Inventor: Shiny Shih, No. 31, Lane 349, Chungcheng S. Rd., Yungkang City, Tainan Hsien (TW)

( * ) Notice: Subject to any disclaimer, the term of this patent is extended or adjusted under 35 U.S.C. 154(b) by 0 days.

(21) Appl. No.: 10/340,592

(22) Filed: Jan. 13, 2003

(51) Int. Cl.[7] ..... B41K 1/42; B41F 31/00; B41F 1/00

(52) U.S. Cl. ..... 101/333; 101/327; 101/479; 101/483

(58) Field of Search ..... 101/333, 327, 101/479, 483

(56) References Cited

U.S. PATENT DOCUMENTS 5,105,738 A * 4/1992 Mehaffey ..... 101/333
5,123,349 A * 6/1992 Beaver et al. ..... 101/333
5,191,837 A * 3/1993 Bolton ..... 101/333

* cited by examiner

*Primary Examiner*—Andrew H. Hirshfeld
*Assistant Examiner*—Marvin P Crenshaw
(74) *Attorney, Agent, or Firm*—Rabin & Berdo, P.C.

(57) ABSTRACT

A portable stamp is composed of a housing, a handle, a character unit, a control unit, and a cover. The handle is movably received in the housing, and the character unit is pivotally mounted at a distal end of the handle. The control unit extends through the housing and the handle. The cover is mounted on an open end of the housing. A user can press down the control unit to push the handle and the character unit out from the housing for stamping by using only one hand, which is convenient to operate and will not dirty the hand.

7 Claims, 8 Drawing Sheets

PORTABLE STAMP

BACKGROUND OF THE INVENTION

1. Field of the Invention

The present invention is related to a portable stamp, and more particularly to a stamp which can be used with only one hand.

2. Description of Related Art

Conventional stamps must be used with an inkpad, which is very inconvenient for a user. Thus, some portable stamps, which can be directly used without inkpads, have been invented to mitigate the shortcoming. However, these portable stamps must be operated by using two hands and may dirty the hands with ink.

Therefore, the invention provides a portable stamp to mitigate and/or obviate the aforementioned problems.

SUMMARY OF THE INVENTION

The main objective of the invention is to provide a portable stamp which can be mainly operated by using only one hand.

Another objective of the invention is to provide a portable stamp which will not dirty the hand of a user.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
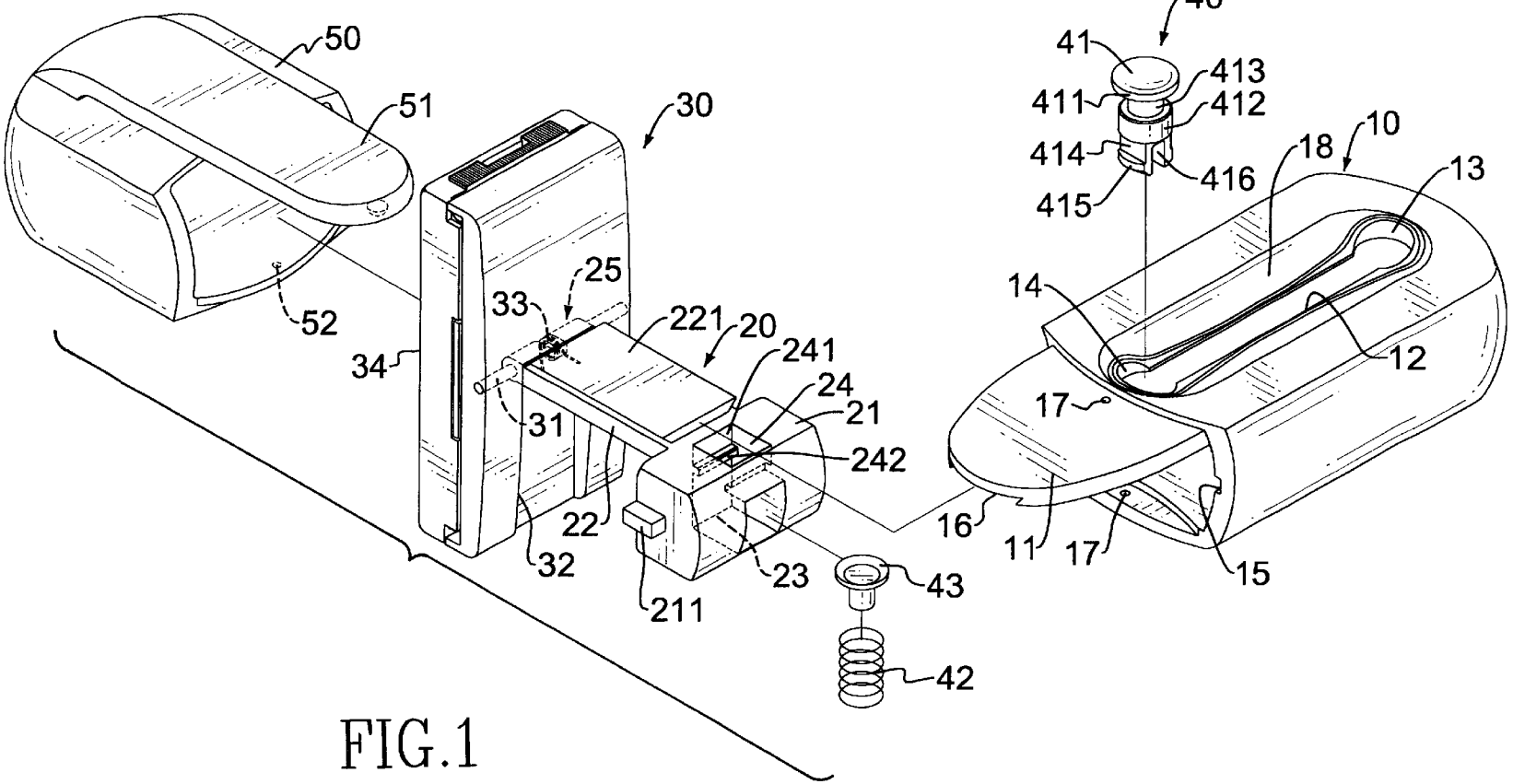
FIG. 1 is an exploded perspective view of a portable stamp in accordance with the invention.
Figure 2:
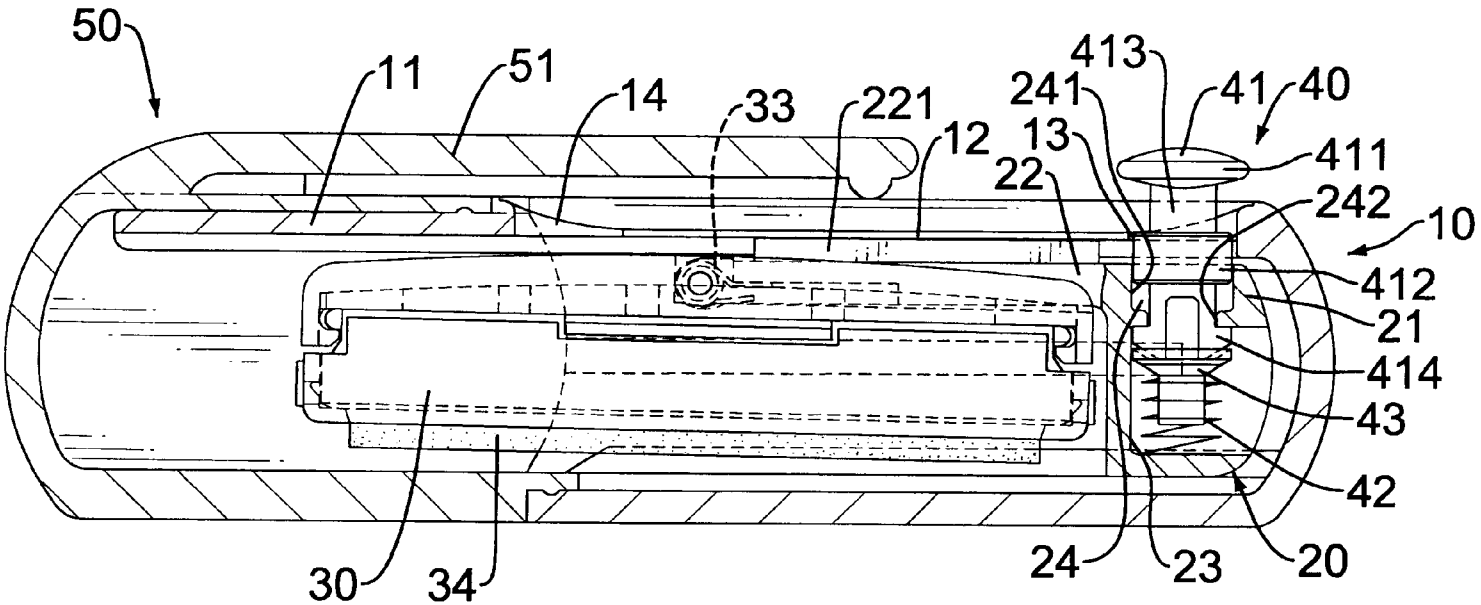
FIG. 2 is a sectional side view of the portable stamp in FIG. 1.

Referring to FIGS. 1 and 2, a portable stamp in accordance with the invention is composed of a housing (10), a handle (20), a character unit (30), a control unit (40), and a cover (50).

The housing (10) has a tongue (11) formed at an open end thereof, and an elongated slot (12) defined at an upper surface thereof. A first hole (13) and a second hole (14), both of which have a diameter that is larger than a width of the elongated slot (12), are respectively defined at two ends of the elongated slot (12). Two inclined surfaces (18) are respectively formed at two sides of the elongated slot (12).

Two channels (15) are respectively defined at two opposite inner sidewalls of the housing (10). A notch (16) is defined at a bottom surface of the tongue (11). Two apertures

(17) are respectively defined at an upper surface of the tongue (11) and in an inner bottom surface of the housing (10) opposite to the tongue (11).

The handle (20) has a sliding block (21) movably mounted in the housing (10) and a bar (22) extending from the sliding block (21). Two ears (211) are respectively formed at two side of the sliding block (21) and received in the guide channels (15). A guide member (221) is formed at a top surface of the bar (22) and can be received in and moved along the notch (16) of the housing (10). A positioning opening (24) is defined at a top side of the sliding block (21), and a lateral opening (23) is defined at a side perpendicular to the top side and in communication with the positioning opening (24). The positioning opening (24) has an upper opening (241), and a lower opening (242) with a diameter smaller that a diameter of the upper opening (241). The diameter of the upper opening (241) is larger than the width of the elongated slot (12), and substantially equals the diameter of the first and second holes (13, 14). A pivoting part (25) is formed at a distal end of the bar (22) for pivotally mounting the character unit (30).

The character unit (30) is pivotally mounted at the distal end of the bar (22) by a pivot pin (31) inserted through the pivoting part (25). A recess (32) is defined at a back surface of the character unit (30) for receiving the bar (22) when the character unit (30) is pivoted to abut the bar (22) and received in the housing (10). A torsional spring (33) is provided on the pivot pin (31) and a character plate (34) is provided at a front surface of the character unit (30). An ink sponge (not shown or numbered) is provided inside the character unit (30) to supply ink to the character plate (34).

The control unit (40) has a button (41) inserted in the positioning opening (24) and extending out from the first hole (13) when the handle (20) and the character unit (30) are received in the housing (10). The button (41) has cap (411) formed at a top end thereof. A middle part (412) is formed below the cap (411) and received in the first opening (241) of the positioning opening (24) and in the first hole (13). A neck (413) with a diameter substantially equal to the width of the elongated slot (12) is formed between the cap (411) and the middle part (412). Two legs (414) are formed beneath the middle part (412) and received in the second opening (242) of the positioning opening (24). Two stops (415) are respectively formed at outer sides of the legs (414), and a gap (416) is defined between the legs (414). Specially referring to FIG. 3, the stops (415) are attached to a bottom edge of the second opening (242) to fasten the button (41) in the positioning opening (24). A resilient member (42) is received in the lateral opening (23) and pressed by the legs (414), and a washer (43) is provided between the resilient member (42) and the legs (414).

Referring back to FIGS. 1–2, the cover (50) is mounted at the open end of the housing (10) to receive the tongue (11) and the character unit (30). A clip (51) is formed on the cover (50) and abuts the tongue (11). Two lugs (52) are respectively formed at a bottom side of the clip (51) and on an inner wall of the cover (50), and positioned in the corresponding apertures (17).

Figure 3:
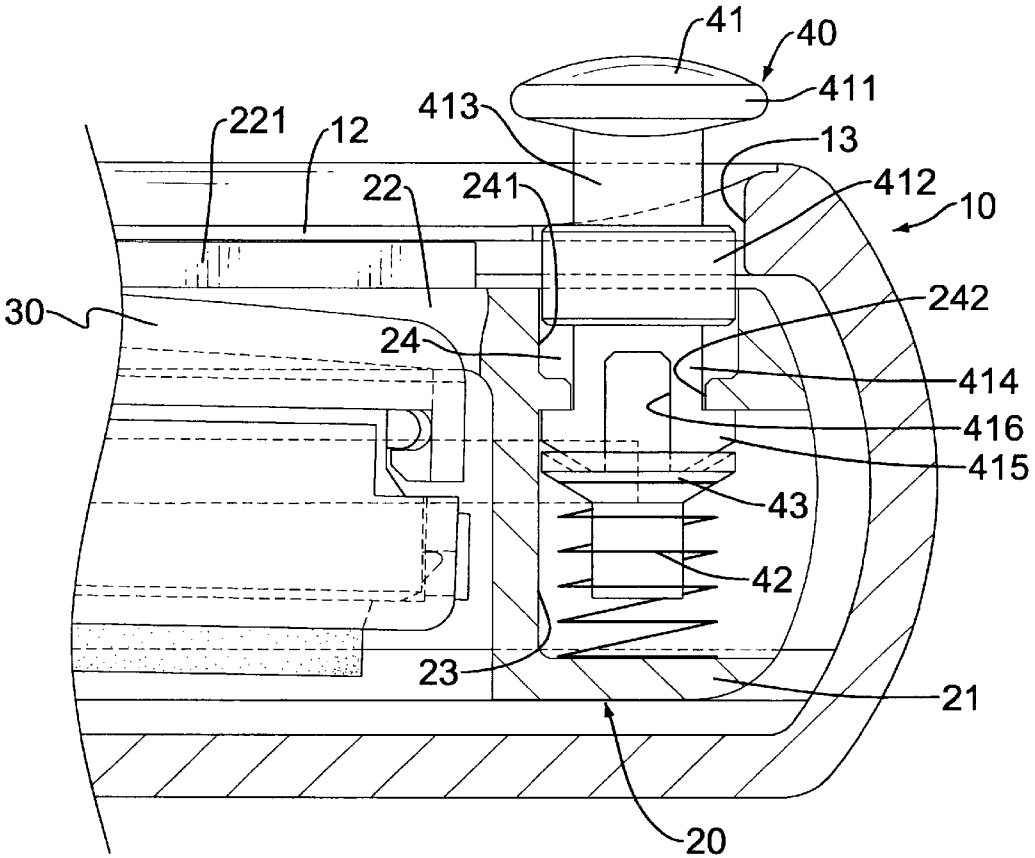
FIG. 3 is a partially enlarged view of FIG. 2.

Referring to FIGS. 2–3, in a received status, the character unit (30) is pivoted to abut the handle (20) and received in the housing (10), and the cover (50) is mounted on the housing (10). The middle part (412) of the button (41) is located in the first hole (13) and blocked by the elongated slot (12) under the force of the resilient member (42). Thus, the handle (20) and the character unit (30) cannot be moved.

Figure 4:
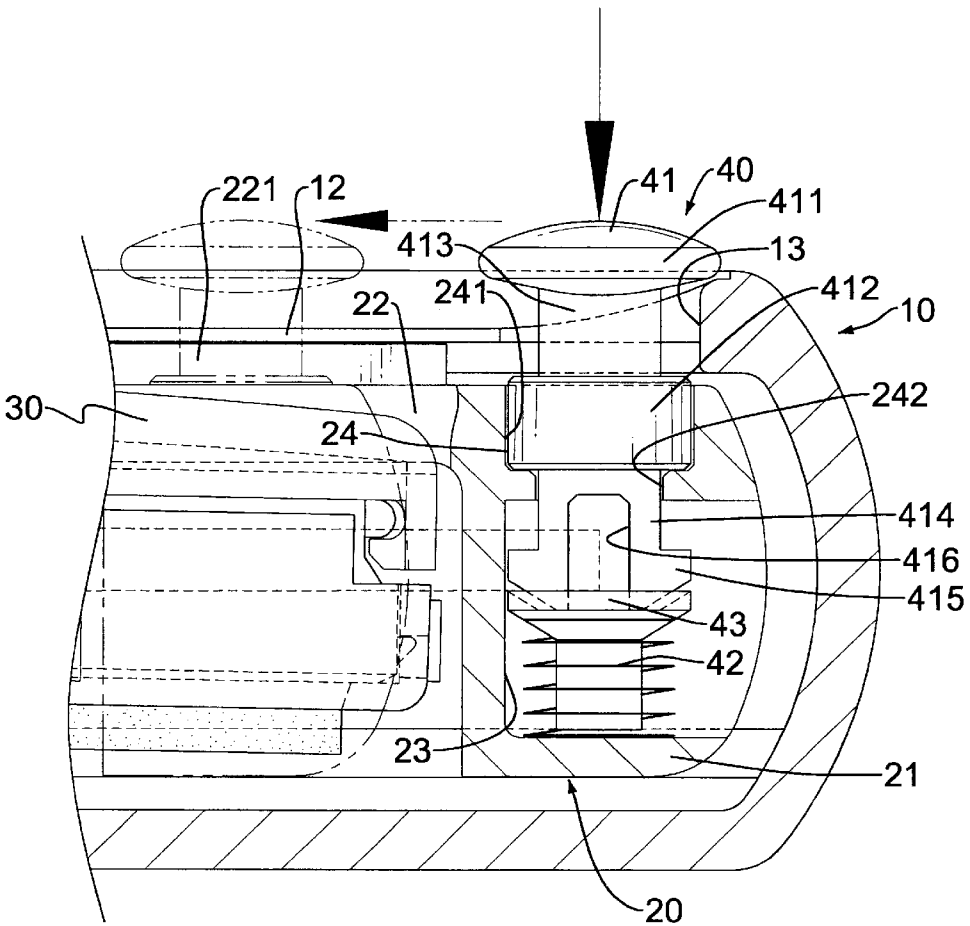
FIG. 4 is a partially enlarged view of the portable stamp when a button is pressed downwards.
Figure 5:
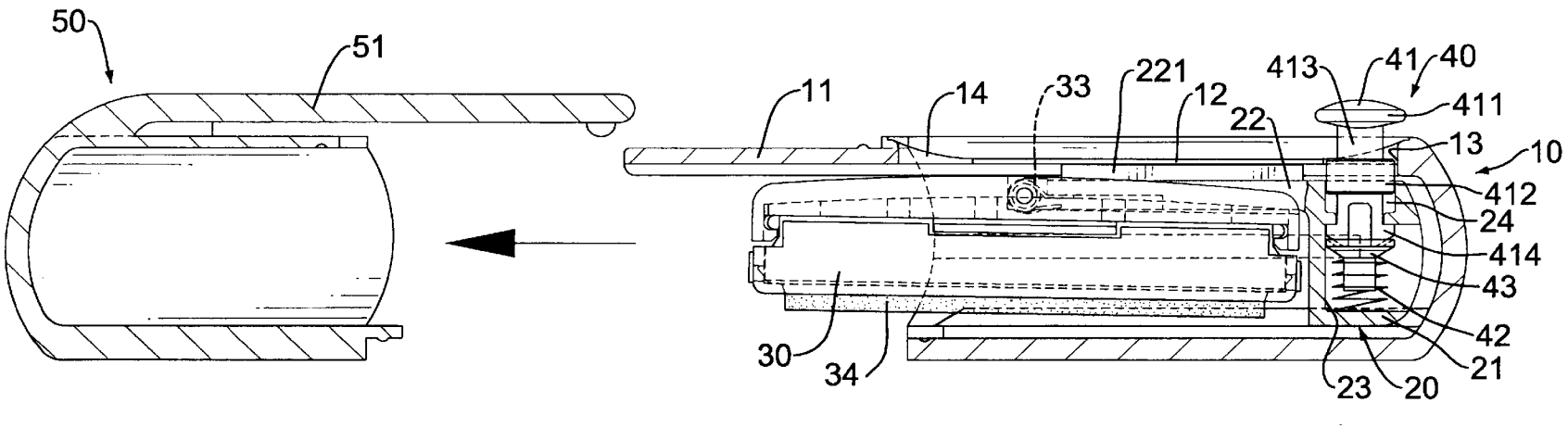
FIG. 5 is a sectional side view showing that a cover of the portable stamp is removed.

Referring to FIGS. 4–5, when the button (41) is pressed downwards after the cover (50) is removed, the middle part (412) is disengaged from the elongated slot (12) to locate the neck (413) in the elongated slot (12). Therefore, the button (41) can be moved along the elongated slot (12), and a user can hold the button (41) to push the handle (20) and the character unit (30) towards the second hole (14) and out from the housing (10).

Figure 6:
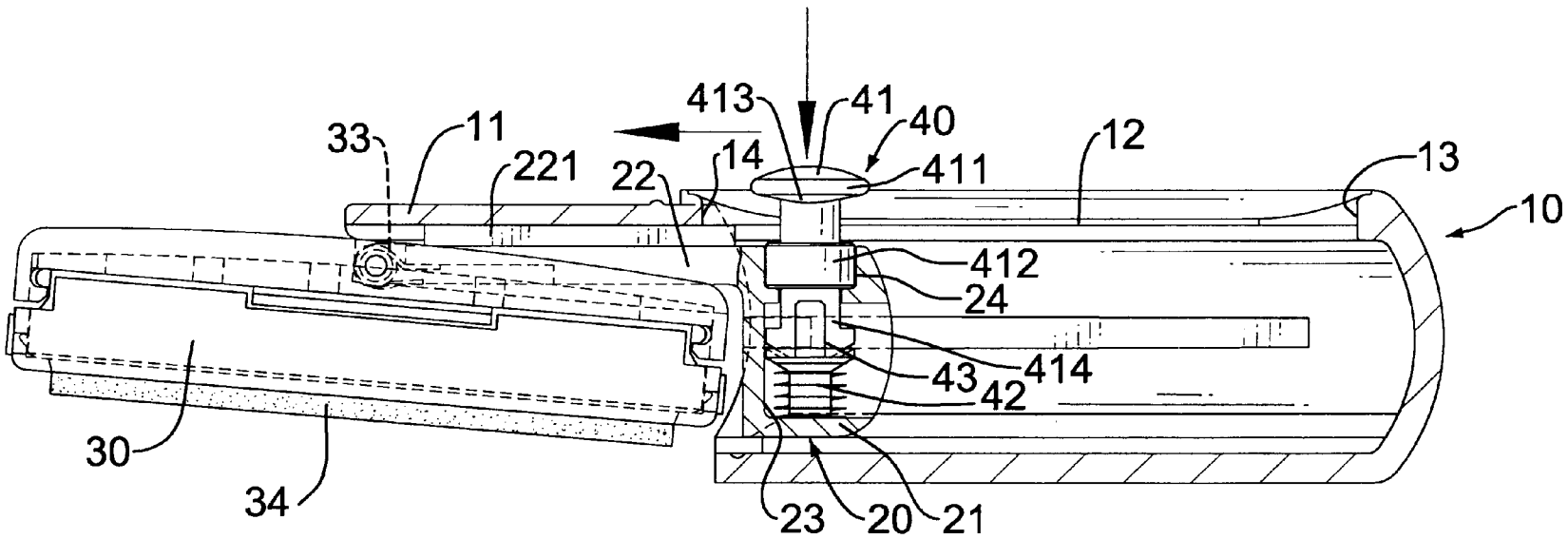
FIG. 6 is a sectional side view showing that a character unit is pushed out from a housing of the portable stamp.
Figure 7:
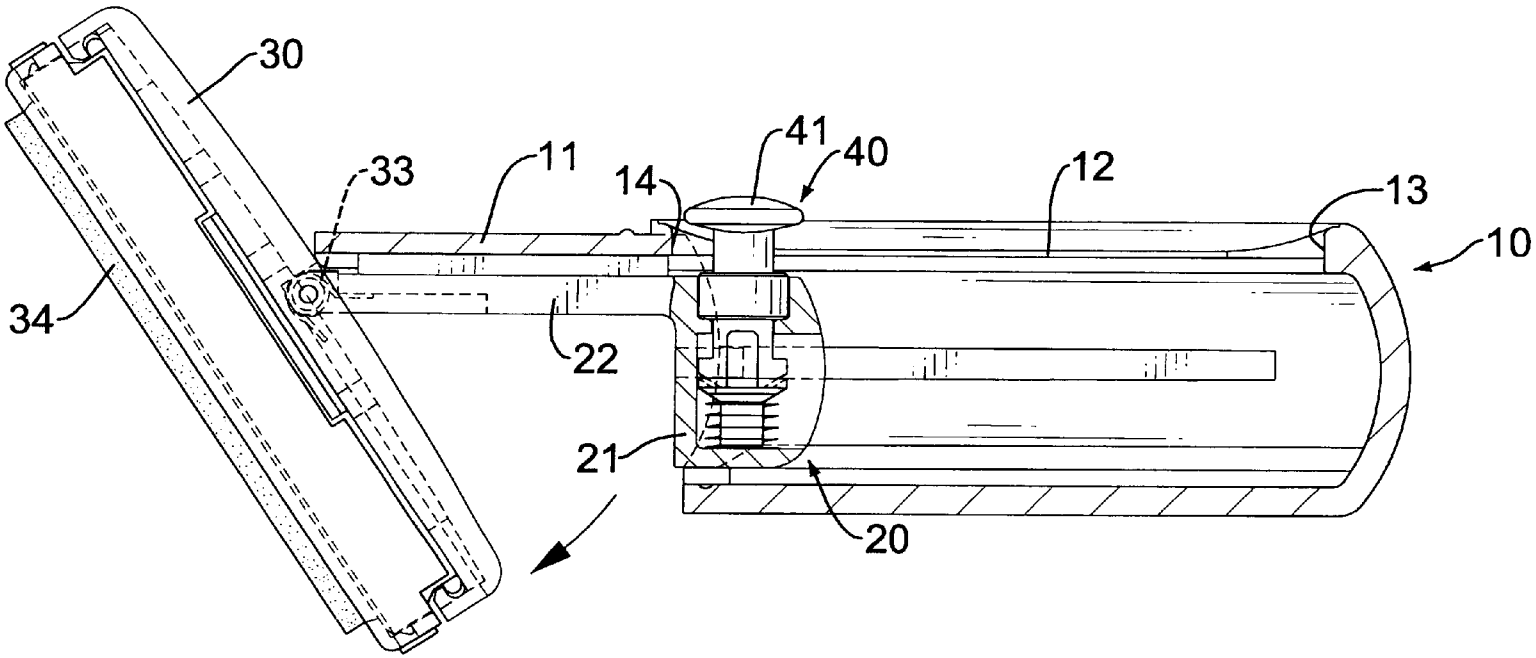
FIG. 7 is a sectional side view of the character unit is pivoted.
Figure 8:
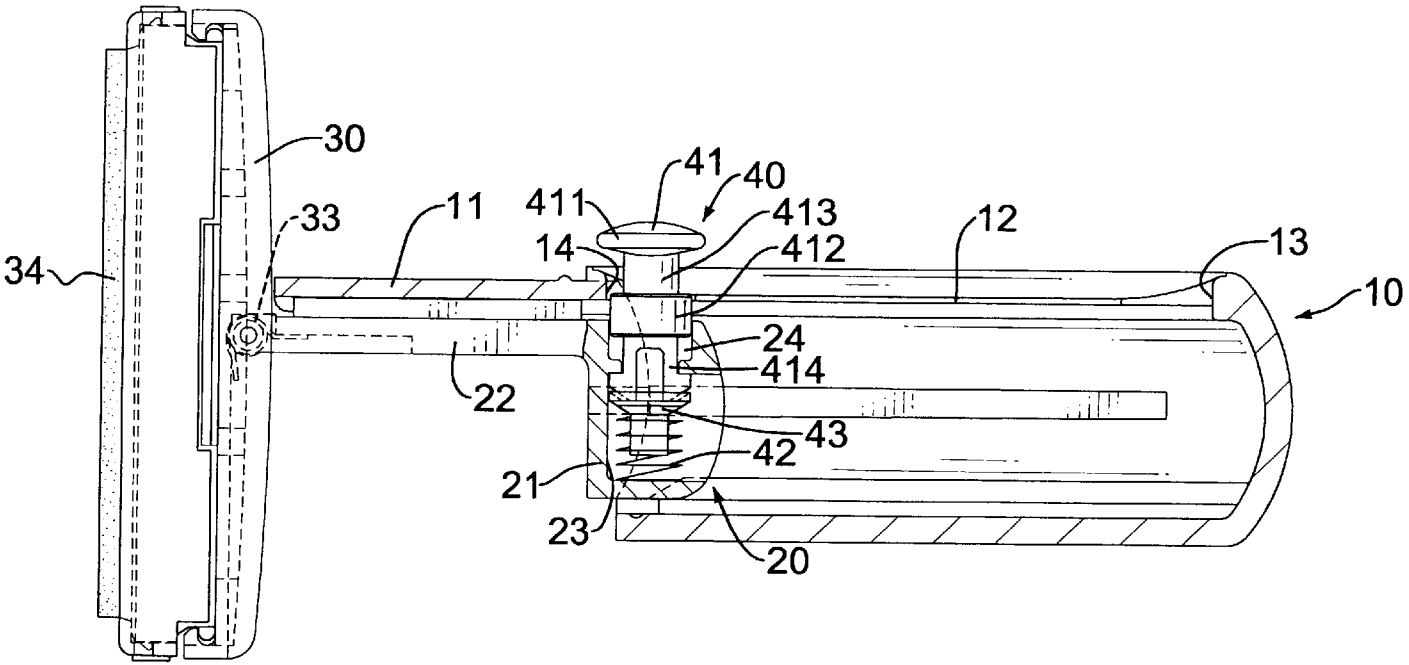
FIG. 8 is a sectional side view of the portable stamp in a used status.

Referring to FIGS. 6–8, when the character unit (30) completely exits the housing (10), under the force of the torsional spring (33), the character unit (30) is pivoted to make the character plate (34) perpendicular to the tongue (11) and the bar (22). After the user releases the button (41), under the force of the resilient member (43), the button (41) is located in the second hole (14) and the middle part (412) is blocked by the elongated slot (12), so that the character unit (30) can be used for stamping and will not be retracted.

After stamping, the user can press down the button (41) and push it towards the first hole (13). The character unit (30) is pushed by the tongue (11) to pivot downwards to abut the bar (22), so that the handle (20) and the character unit (30) can be received in the housing (10). Thereafter, the cover (50) is installed on the housing (10).

Except removing and installing the cover (50), the processing described above can be accomplished by using only one hand of the user, so it is very convenient and easy to use the stamp. Furthermore, the hands of the user will not be dirtied by ink of the character plate.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A portable stamp comprising:

a housing (10) having a tongue (11) formed at an open end thereof, an elongated slot (12) defined through an upper surface thereof, a first hole (13) and a second hole (14). respectively defined at two ends of the elongated slot (12), wherein a diameter of the holes (13, 14) is larger than a width of the elongated slot (12);

a handle (20) having a sliding block (21) movably receiving in the housing (10), a bar (22) extending from the sliding block (21), a positioning opening (24) defined a top side of the sliding block (21), a lateral opening (23) defined at a side perpendicular to the top side of the sliding block (21) and in communication with the positioning opening (24), and a pivoting part (25) formed at a distal end of the bar (22);

a character unit (30) pivotally mounted on the distal end of the bar (22), the character unit (30) having a pivot pin (31) provided at a back surface and inserted through the pivoting part (25), a torsional spring (33) provided on the pivot pin (31), a character plate (34) provided at a front surface of the character unit (30), and an ink sponge provided inside the character unit (30);

a control unit (40) having a button (41) received in the positioning opening (24), and a resilient member (42) received in the lateral opening (23) and pressed against the button (41), wherein the button (41) has a cap (411) formed at a top end thereof, a middle part (412) below the cap (411) fitted into the positioning opening (24) with a diameter larger than the width of the elongated slot (12), and a neck (413) between the cap (411) and the middle part (412) with a diameter smaller than the width of the elongated slot (12); and a cover (50) installed on the open end of the housing (10).

2. The portable stamp as claimed in claim 1, wherein the positioning opening (24) is composed of a first opening (241), and a second opening (242) with a diameter smaller than that of the first opening (241); and the button (41) has two legs (414) formed beneath the middle part (412) and received in the second opening (242), and two stops (415) respectively formed at outer sides of the legs (414) and attached to a bottom edge of the second opening (242).

3. The portable stamp as claimed in claim 1, wherein the control unit (40) further comprises a washer (43) between the button (41) and the resilient member (42).

4. The portable stamp as claimed in claim 1, wherein the character unit (30) further comprises a recess (32) defined at the back surface thereof for receiving the bar (22).

5. The portable stamp as claimed in claim 1, wherein the housing (10) further comprises two channels (15) respectively defined at two opposite inner side walls thereof; and the sliding block (21) has two ears (211) respectively formed at two sides thereof and received in the channels (15).

6. The portable stamp as claimed in claim 1, wherein the housing (10) further comprises a notch (16) defined at a bottom surface of the tongue (11); and the handle (20) has a guide (221) formed on an upper surface of the bar (22) and located in the notch (16).

7. The portable stamp as claimed in claim 1, wherein the housing (10) further comprises two apertures (17) respectively defined on an upper surface of the tongue (11), and in an inner bottom surface of the housing (10) opposite to the tongue (11); and the cover (50) has a clip (51) formed thereon the cover (50) and abutting the tongue (11), and two lugs (52) respectively formed at a bottom side of the clip (51) and on an inner wall of the cover (50), and positioned in the corresponding apertures (17).

* * * * *